US008924208B2

(12) United States Patent
Yamanashi et al.

(10) Patent No.: US 8,924,208 B2
(45) Date of Patent: Dec. 30, 2014

(54) ENCODING DEVICE AND ENCODING METHOD

(75) Inventors: Tomofumi Yamanashi, Kanagawa (JP); Masahiro Oshikiri, Kanagawa (JP)

(73) Assignee: Panasonic Intellectual Property Corporation of America, Torrance, CA (US)

( * ) Notice: Subject to any disclaimer, the term of this patent is extended or adjusted under 35 U.S.C. 154(b) by 310 days.

(21) Appl. No.: 13/521,112

(22) PCT Filed: Jan. 12, 2011

(86) PCT No.: PCT/JP2011/000096

§ 371 (c)(1),
(2), (4) Date: Jul. 9, 2012

(87) PCT Pub. No.: WO2011/086900

PCT Pub. Date: Jul. 21, 2011

(65) Prior Publication Data

US 2012/0296640 A1 Nov. 22, 2012

(30) Foreign Application Priority Data

Jan. 13, 2010 (JP) ..... 2010-004978

(51) Int. Cl.
*G10L 19/02* (2013.01)
*G10L 19/032* (2013.01)

(52) U.S. Cl.
CPC ..... *G10L 19/0208* (2013.01); *G10L 19/032* (2013.01)
USPC ..... 704/230

(58) Field of Classification Search
CPC ..... G10L 19/032
USPC ..... 704/230
See application file for complete search history.

(56) References Cited

U.S. PATENT DOCUMENTS 6,871,106 B1 3/2005 Ishikawa et al.
7,106,228 B2 * 9/2006 Bessette et al. ..... 341/106

(Continued)

FOREIGN PATENT DOCUMENTS

CN 1240978 1/2000
CN 101849258 9/2010

(Continued)

OTHER PUBLICATIONS

Stephane Ragot et al., "Low-complexity Multi-rate Lattice Vector Quantization with Application to Wideband TCX Speech Coding at 32kbit/s", Proceedings of the IEEE International Conference on Acoustics, Speech, and Signal Processing, 2004, May 17, 2004, vol. I pp. 501-504.

(Continued)

*Primary Examiner* — Susan McFadden
(74) *Attorney, Agent, or Firm* — Greenblum & Bernstein, P.L.C.

(57) ABSTRACT

An encoding device and encoding method improve a quality of a decoded signal under very low bit rate conditions using a small amount of computation. A spectrum corrector performs correction processing on a subspectrum in each subband in such a manner that samples equal to or greater than a sub-spectrum average value are left unchanged and samples smaller than the subspectrum average value are replaced by zero. As a result of this, it is possible to significantly reduce the number of bits required to quantize the subspectrums without a substantial reduction in quality in a local searcher and in a multi-rate indexer.

8 Claims, 5 Drawing Sheets

(56) References Cited

U.S. PATENT DOCUMENTS

| | | | | |
|---|---|---|---|---|
| 7,110,953 | B1 * | 9/2006 | Edler et al. | 704/200.1 |
| 8,135,588 | B2 * | 3/2012 | Oshikiri et al. | 704/229 |
| 8,311,818 | B2 * | 11/2012 | Oshikiri et al. | 704/229 |
| 2005/0285764 | A1 | 12/2005 | Bessette et al. | |
| 2006/0004565 | A1 | 1/2006 | Eguchi | |
| 2007/0162236 | A1 | 7/2007 | Lamblin et al. | |
| 2009/0240491 | A1 | 9/2009 | Reznik | |
| 2012/0245931 | A1 | 9/2012 | Yamanashi et al. | |

FOREIGN PATENT DOCUMENTS

| | | |
|---|---|---|
| EP | 2490216 | 8/2012 |
| JP | 9-230898 | 9/1997 |
| JP | 11-330977 | 11/1999 |
| JP | 2001-007704 | 1/2001 |
| JP | 2005-528839 | 9/2005 |
| WO | 2009/059333 | 5/2009 |

OTHER PUBLICATIONS

Minjie Xie et al., "Embedded Algebraic Vector Quantizers (EAVQ) with Application to Wideband Speech Coding", IEEE 1996, pp. 240-243.

ITU-T:G.718, "Frame error robust narrow-band and wideband embedded variable bit-rate coding of speech and audio from 8-32kbit/s", ITU-T Recommendation G.718, Jun. 2008.

Kokes M G et al., "Spectral entropy-based wideband speech coding", Signals, Systems and Computers, 2000. Conference Record of the Thirty-Fourth Asilomar Conference on Oct. 29-Nov. 1, 2000, Piscataway, NJ, USA, IEEE, XP032142482, Oct. 29, 2000, pp. 1464-1468.

Search report from E.P.O., mail date is Dec. 9, 2013.

* cited by examiner

ENCODING DEVICE AND ENCODING METHOD

TECHNICAL FIELD

The present invention relates to an apparatus and a method of encoding signals, used in a communication system that transmits the signals.

BACKGROUND ART

Compression/coding techniques are often used in transmitting speech/sound signals in a packet communication system typified by internet communication, and a mobile communication system, for the purpose of improving the transmission efficiency of speech/sound signals. In recent years, a need for a coding technique involving processing with a low amount of computation or a multi-rate coding technology rather than simply encoding speech/audio signals at low bit rate has been increasing.

To meet this need, various techniques for encoding speech/sound signals with a low amount of computation without significantly increasing the amount of information after coding have been developed. Non-Patent Literature 1, for example, discloses a technique that divides spectrum data acquired by transforming input signals in a predetermined time, into a plurality of sub-vectors and performs multi-rate coding for each sub-vector. Non-Patent Literature 2, Non-Patent Literature 3, and Patent Literature 1 also disclose a technique related to EAVQ (Embedded Algebraic Vector Quantization) disclosed in the above Non-Patent Literature 1.

CITATION LIST

Patent Literature

PLT 1

Published Japanese Translation No. 2005-528839 of the PCT International Publication

Non-Patent Literature

NPL 1 Stephane Ragot, Bruno Bessette, and Roch Lefebvre, "Low-complexity Multi-rate Lattice Vector Quantization with Application to Wideband TCX Speech Coding", ICASSP 2004

NPL 2 Minjie Xie and Jean-Pierre Adoul, "Embedded Algebraic Vector Quantizers (EAVQ) with Application to Wideband Speech Coding", IEEE 1996

NPL 3 ITU-T:G.718; Frame error robust narrowband and wideband embedded variable bit-rate coding of speech and audio from 8-32 kbit/s. ITU-T Recommendation G.718 (2008)

SUMMARY OF INVENTION

Technical Problem

The vector quantization technique disclosed in the above conventional art has an advantage that the amount of computation is low, but has a problem that the quality of a decoded signal significantly degrades when an extremely low coding bit rate is used. For example, the AVQ coding scheme disclosed in Non-Patent Literature 3 performs a coding process at a bit rate of 4 kbit/s or 12 kbit/s. Also, 1/4/8/16 bit/frame (except for bits used for coding using Voronoi extension) is employed for each sub-vector quantization. Here, an example case of using a 4 kbit/s coding bit rate will be described. In the coding scheme disclosed in Non-Patent Literature 3, quantization is performed in the descending order of sub-band energy. Here when quantization is performed with 16 bit/frame, there is a case where only a few subbands are quantized at 4 bit/s. In this case, the band portion including quantized subbands in the whole band is extremely small (for example, three to four subbands out of 35 subbands). As a result, the quality of the decoded signal may be unsatisfactory.

It is therefore an object of the present invention to provide a coding apparatus and coding method that can improve the quality of a decoded signal with a low amount of computation under the condition of using a very low bit rate.

Solution to Problem

The coding apparatus according to an aspect of the present invention employs a configuration including: an orthogonal transform section that performs orthogonal transformation of an input signal to form spectrum data; a spectrum correcting section that performs a correction process for the formed spectrum data every subband; and a transform section that transforms the spectrum data subjected to the correction process into a lattice vector.

The coding method according to an aspect of the present invention employs a configuration including the steps of: forming spectrum data through orthogonal transformation of an input signal; performing a correction process for the formed spectrum data every subband; and transforming the spectrum data subjected to the correction process into a lattice vector.

Advantageous Effects of Invention

According to the present invention, it is possible to improve the quality of a decoded signal by encoding wideband spectrum data at a very low bit rate with an extremely low amount of computation.

DESCRIPTION OF EMBODIMENT

An embodiment of the present invention will now be described in detail with reference to the accompanying drawings. Here, a coding apparatus and a decoding apparatus according to the present invention will be described using a speech coding apparatus and a speech decoding apparatus as examples.

Figure 1:
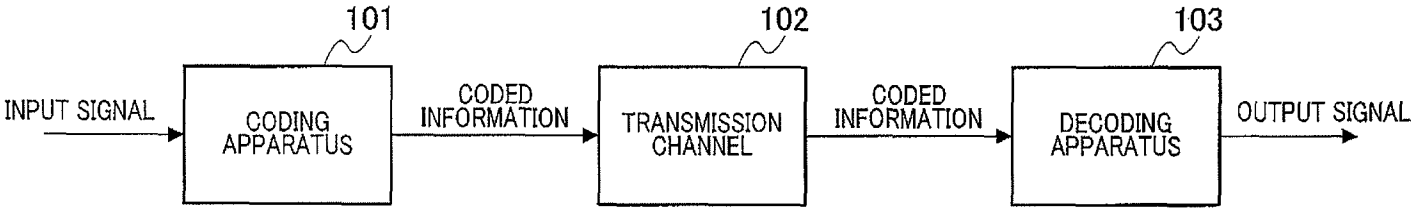
FIG. 1 is a block diagram showing the configuration of a communication system including a coding apparatus and a decoding apparatus according to an embodiment of the present invention.

FIG. 1 is a block diagram showing the configuration of a communication system including a coding apparatus and a decoding apparatus according to an embodiment of the present invention. In FIG. 1, a communication system includes coding apparatus 101 and decoding apparatus 103. Coding apparatus 101 and decoding apparatus 103 can communicate with each other through transmission channel 102. The coding apparatus and the decoding apparatus are usually mounted in, for example, a base station apparatus or a communication terminal apparatus for use.

Coding apparatus 101 segments input signals every N samples (where N is a natural number) and performs coding every frame including N samples. That is to say, N samples constitute a coding processing unit. Here, input signals corresponding to individual coding processing units are represented as $x_n$ (n=0, . . . , N−1). n represents the n+1-th signal element group among the signal element groups, each including the segmented N samples of the input signals. Coding apparatus 101 transmits information acquired by coding (hereinafter, referred to as "coded information") to decoding apparatus 103 through transmission channel 102.

Decoding apparatus 103 receives the coded information transmitted from coding apparatus 101 through transmission channel 102 and decodes the coded information to acquire an output signal.

Figure 2:
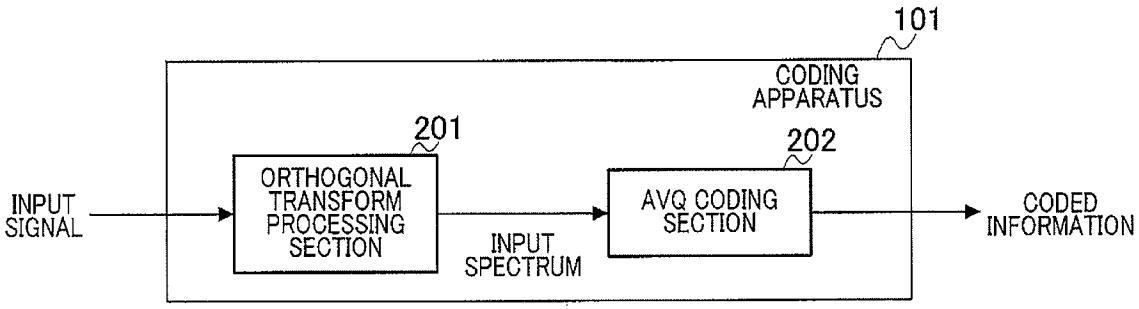
FIG. 2 is a block diagram showing the main configuration inside the coding apparatus shown in FIG. 1.

FIG. 2 is a block diagram showing the main configuration inside encoding apparatus 101 shown in FIG. 1. Coding apparatus 101 is mainly formed of orthogonal transform processing section 201 and AVQ coding section 202. Each section performs the following operations.

Orthogonal transform processing section 201 has buffer $buf1_n$ (n=0, . . . , N−1) inside. Orthogonal transform processing section 201 performs modified discrete cosine transform (MDCT) for input signal $x_n$.

Here, there will be described calculation steps and data output to an internal buffer in orthogonal transform processing (time-frequency transform) performed by orthogonal transform processing section 201.

Orthogonal transform processing section 201 first initializes buffer $buf1_n$ by setting an initial value to "0" using following equation 1.

[1]

$$buf1_n=0(n=0, \ldots, N-1) \quad \text{(Equation 1)}$$

Next, orthogonal transform processing section 201 performs modified discrete cosine transform (MDCT) for input signal $x_n$ in accordance with following equation 2. Orthogonal transform processing section 201 thus acquires MDCT coefficient X(k) of input signals (hereinafter, referred to as an input spectrum).

[2]

$$X(k) = \frac{2}{N}\sum_{n=0}^{2N-1} x'_n \cos\left[\frac{(2n+1+N)(2k+1)\pi}{4N}\right] \quad \text{(Equation 2)}$$

$$(k = 0, \ldots, N-1)$$

Here, k is the index of each sample in one frame.

Orthogonal transform processing section 201 finds vector $x_n'$ resulting from combining input signal $x_n$ with buffer $buf1_n$ according to following equation 3.

[3]

$$x'_n = \begin{cases} buf1_n & (n = 0, \ldots N-1) \\ x_{n-N} & (n = N, \ldots 2N-1) \end{cases} \quad \text{(Equation 3)}$$

Next, orthogonal transform processing section 201 updates buffer $buf1_n$ by equation 4.

[4]

$$buf1_n=x_n(n=0, \ldots N-1) \quad \text{(Equation 4)}$$

Then, orthogonal transform processing section 201 outputs input spectrum X(k) acquired by equation 2 to AVQ coding section 202.

AVQ coding section 202 generates coded information using input spectrum X(k) input from orthogonal transform processing section 201. AVQ coding section 202 outputs the generated coded information to transmission channel 102.

Figure 3:
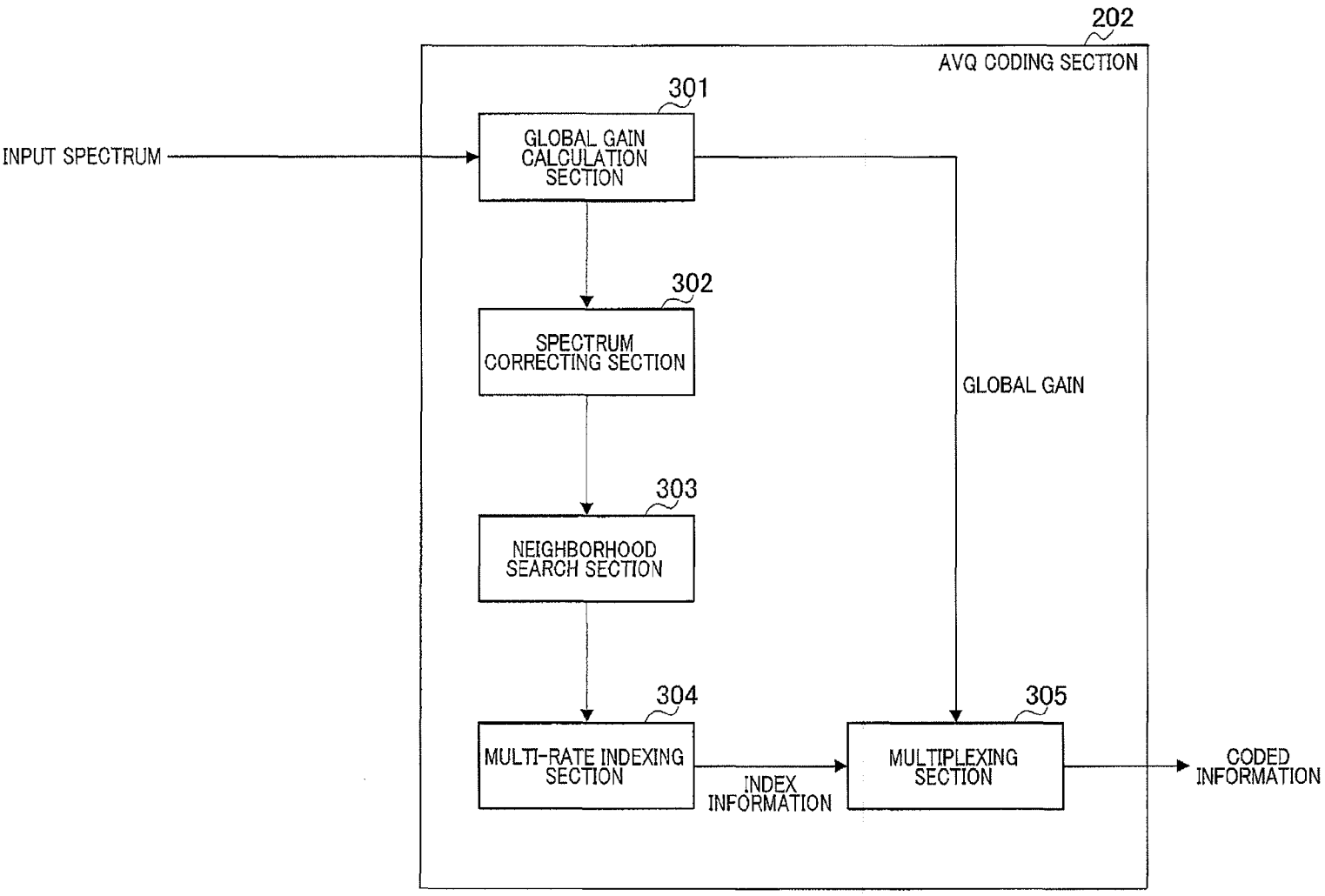
FIG. 3 is a block diagram showing the main configuration inside the AVQ coding section shown in FIG. 2.

FIG. 3 is a block diagram showing the main configuration inside AVQ coding section 202. AVQ coding section 202 is mainly formed of global gain calculation section 301, spectrum correcting section 302, neighborhood search section 303, multi-rate indexing section 304, and multiplexing section 305. Each section performs the following operations.

Global gain calculation section 301 calculates a global gain for input spectrum X(k) input from orthogonal transform processing section 201. Non-Patent Literature 3 discloses a global gain calculation method, and the present embodiment uses the same method. Specifically, global gain calculation section 301 calculates global gain g in accordance with following equation 5 and equation 6. Global gain calculation section 301 outputs the global gain calculated in accordance with equation 6 to multiplexing section 305. Here, NB_BITS in equation 5 represents the number of bits available for coding processing and P represents the number of subbands to divide input spectrum X(k).

[5]

$$\begin{aligned} &\text{Initialize } fac = 128, \\ &\text{offset} = 0, \\ &nbits_{max} = 0.95 \cdot (\text{NB_BITS} - P) \\ &\text{for } i = 1{:}10 \\ &\text{offset} = \text{offset} + fac \\ &nbits = \sum_{p=1}^{P} \max(0, R_p(1) - \text{offset}) \\ &\text{if } nbits \le nbits_{max}, \text{ then} \\ &\text{offset} = \text{offset} - fac \\ &fac = fac/2 \end{aligned} \quad \text{(Equation 5)}$$

[6]

$$g = 10^{\left(\frac{offset \log_{10}(2)}{10}\right)} \quad \text{(Equation 6)}$$

To be more specific, the first step of equation 5 discloses an equation related to initialization. After initialization, the first offset calculation is performed using an equation in the third step of equation 5. On the other hand, the second offset calculation is performed using equations in the sixth and seventh step. Also, n bits is calculated from the equation in step 4. Then, an offset calculated by the first offset calculation or an offset calculated by the second offset calculation is selected based on a condition in the fifth step. That is to say, when the condition in the fifth step is not satisfied, the offset calculated by the first offset calculation is selected. On the other hand, when the condition in the fifth step is satisfied, the offset calculated by the second offset calculation is selected.

Then, in equation 6, global gain g is calculated based on the selected offset in equation 5. This global gain g is outputted to multiplexing section 305.

Also, global gain calculation section 301 normalizes input spectrum X(k) in accordance with equation 7 using global gain g calculated by equation 6 and outputs normalized input spectrum X2($k$) to spectrum correcting section 302.

[7]

$$X2(k)=X(k)/g(k=0, \ldots, N-1) \quad \text{(Equation 7)}$$

Spectrum correcting section 302 divides normalized input spectrum X2($k$) input from global gain calculation section 301 into P subbands as with a process in global gain calculation section 301. Here, the number of samples (MDCT coefficients) forming each of P subbands, that is to say, subband width is Q(p). It is noted that, although a case where every subband has a width equal to Q will be described for simplification, the present invention can be equally applied to a case where each subband has a different subband width.

Spectrum correcting section 302 corrects a spectrum of each of subbands P resulting from the division. In the following explanation, a spectrum of each subband is referred to as a sub-spectrum $SS_p(k)$ ($p=0, \ldots, P-1$, $k=BS_p, \ldots, BE_p$). Also, a sub-spectrum subjected to a correction process is referred to as corrected sub-spectrum $MSS_p(k)$ ($p=0, \ldots, P-1$, $k=BS_p, \ldots, BE_p$). Here, $BS_p$ represents an index of the beginning sample of each subband and $BE_p$ represents an index of the end sample of each subband.

Here, a method of correcting a sub-spectrum in spectrum correcting section 302 will be described.

First, spectrum correcting section 302 calculates an average amplitude value $Ave_p$ of sub-spectrum $SS_p(k)$ for each subband in accordance with following equation 8.

[8]

$$Ave_p = \frac{\sum_{k=BS_p}^{BE_p} |SS_p(k)|}{Q} \quad (p = 0, \ldots, P-1) \quad \text{(Equation 8)}$$

Next, spectrum correcting section 302 corrects a sub-spectrum of each subband and calculates corrected sub-spectrum $MSS_p(k)$ in accordance with following equation 9 using sub-spectrum average value $Ave_p$ calculated by equation 8.

[9]

$$MSS_p(k) = \begin{cases} SS_p(k) & \text{if } |SS_p(k)| \geq Ave_p \\ 0 & \text{else} \end{cases} \quad \text{(Equation 9)}$$

$$\begin{pmatrix} p = 0, \ldots, P-1 \\ k = BS_p, \ldots, BE_P \end{pmatrix}$$

That is to say, spectrum correcting section 302 executes, on a sub-spectrum of each subband, a correction process which does not correct samples equal to or more than a sub-spectrum average, but which assigns zero to samples less than the sub-spectrum average.

The above correction process in spectrum correcting section 302 corrects a sub-spectrum such that all samples other than samples having a relatively great amplitude (that is to say, perceptually-important samples) are zero. That is to say, the above process in spectrum correcting section 302 emphasizes and simplifies the characteristic of a sub-spectrum. By this means, it is possible to significantly reduce the number of bits necessary for sub-spectrum quantization without great quality degradation in later described neighborhood search section 303 and multi-rate indexing section 304. Consequently, the number of subbands to be encoded can be increased, so that a band spread (a bandwidth) of a decoded signal is improved. Specific examples will be described later herein.

Next, spectrum correcting section 302 outputs corrected sub-spectrum $MSS_p(k)$ to neighborhood search section 303.

Neighborhood search section 303 calculates a neighborhood vector (a lattice vector) of corrected sub-spectrum $MSS_p(k)$ by using the technique disclosed in Non-Patent Literature 1 and Non-Patent Literature 3 for corrected sub-spectrum $MSS_p(k)$ input from spectrum correcting section 302. Specifically, neighborhood search section 303 calculates a sub-vector (a lattice vector) included in $RE_8$ in accordance with equation 10. Here, see Non-Patent Literature 1 and Non-Patent Literature 2 for a detailed process regarding $RE_8$ and equation 10.

[10]

set $z_p = 0.5 \cdot X2(k)$ (Equation 10)
Round each componet of $z_p$ to the nearest
integer, to generate $z'_p$
Set $y_{1p} = 2^{z'_p}$
Calculate $S$ as the sum of the components of $y_{1p}$
if $S$ is not an integer multiple of 4,
then modify one of its components as follows:
find the position $I$ where $\text{abs}[z_p(i) - y_{1p}(i)]$
is the highest
if $z_p(I) - y_{1p}(I) < 0$, then $y_{1p}(I) = y_{1p}(I) - 2$
if $z_p(I) - y_{1p}(I) > 0$, then $y_{1p}(I) = y_{1p}(I) + 2$
set $z_p = 2^{z'_p}$
Calculate $S$ as the sum of the components of $y_{2p}$
Find the position $I$ where $\text{abs}[z_p(i) - y_{2p}(i)]$
is the highest
if $z_p(I) - y_{2p}(I) < 0$, then $y_{2p}(I) = y_{2p}(I) - 2$
if $z_p(I) - y_{2p}(I) > 0$, then $y_{2p}(I) = y_{2p}(I) + 2$
$y_{2p} = y_{2p} + 1.0$
Compute $e_{1p} = (X2(k) - y_{1p}(k))$ and
$e_{2p} = (X2(k) - y_{2p}(k))$
if $e_{1p} > e_{2p}$ then the best lattice point is $y_{1p}$
otherwise the best lattice point is $y_{2p}$ Neighborhood search section 303 outputs the calculated neighborhood vector ($y_{1p}$ or $y_{2p}$ in equation 10) to multi-rate indexing section 304.

Multi-rate indexing section 304 calculates index information from the neighborhood vector input from neighborhood search section 303 using a technology disclosed in Non-Patent Literature 1 and Non-Patent Literature 3. Here, since Non-Patent Literature 3 discloses detailed process in multi-rate indexing section 304, the explanations thereof will be omitted. Multi-rate indexing section 304 outputs the calculated index information to multiplexing section 305.

Multiplexing section 305 multiplexes global gain g input from global gain calculation section 301 with the index information input from multi-rate indexing section 304, generates coded information, and outputs the generated coded information to decoding apparatus 103 through transmission channel 102.

Here, as an example showing an effect of the present invention, a case of encoding a sub-spectrum (a test sub-spectrum) having eight subband widths {−4.4, 0.4, 1.6, 0.3, 4.4, 0.4, −1.6, −0.4} will be studied. At this time, neighborhood search section 303 transforms the sub-spectrum into a vector {4, 0, 2, 0, 4, 0, 2, 0} and further selects a leader {4, 4, 2, 2, 0, 0, 0, 0}. Since this leader belongs to Q4, 16 bits are required for encoding the leader. However, spectrum correcting section 302 corrects the above test sub-spectrum, thereby correcting the test sub-spectrum to corrected test sub-spectrum {−4.4, 0.0, 0.0, 0.0, 4.4, 0.0, 0.0, 0.0}. Neighborhood search section 303 transforms the corrected test sub-spectrum into a vector {4, 0, 0, 0, 4, 0, 0, 0} and further selects a leader {4, 4, 0, 0, 0, 0, 0, 0}. Since this leader belongs to Q3, 12 bits are required for encoding the leader. Accordingly, it is possible to reduce 4 bits information amount without great quality degradation by correcting a vector so as to assign zero to values of samples other than important samples having a relatively great amplitude.

The process in coding apparatus 101 has been described hereinbefore.

Figure 4:
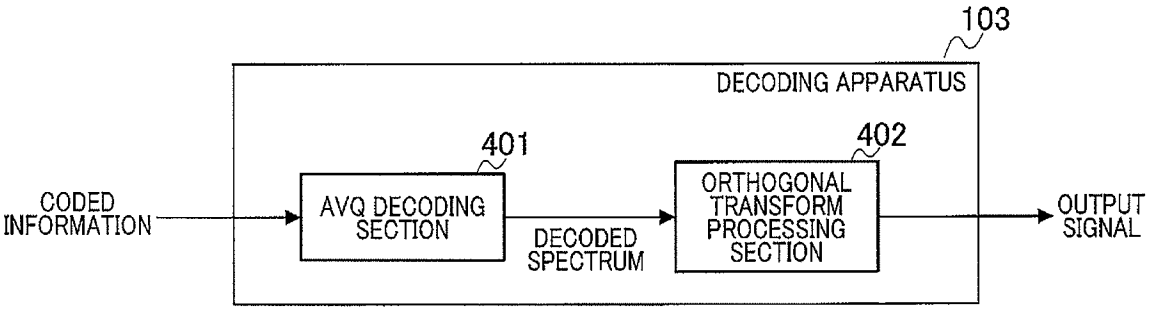
FIG. 4 is a block diagram showing the main configuration inside the decoding apparatus shown in FIG. 1.

FIG. 4 is a block diagram showing a main configuration inside decoding apparatus 103 shown in FIG. 1. Decoding apparatus 103 is mainly formed of AVQ decoding section 401 and orthogonal transform processing section 402. Each section performs the following operations.

AVQ decoding section 401 calculates decoded spectrum X2'(k) using coded information input through a transmission channel. AVQ decoding section 401 outputs the generated decoded spectrum X2'(k) to orthogonal transform processing section 402. Details of AVQ decoding section 401 processing will be described later.

Orthogonal transform processing section 402 has inside buffer buf2($k$) and initializes buffer buf2($k$) as shown in following equation 11.

[11]

$$\mathrm{buf2}(k)=0(k=0,\ldots,N-1) \quad \text{(Equation 11)}$$

Also, orthogonal transform processing section 402 acquires decoded signal $y_n$ in accordance with following equation 12 using decoded spectrum X2'(k) input from AVQ decoding section 401 and outputs decoded signal $y_n$.

[12]

$$y_n = \frac{2}{N}\sum_{n=0}^{2N-1} Z(k)\cos\left[\frac{(2n+1+N)(2k+1)\pi}{4N}\right] \quad \text{(Equation 12)}$$

$$(n = 0, \ldots, N-1)$$

Z(k) in equation 12 is a vector obtained by combining decoded spectrum X2'(k) with buffer buf2($k$) as shown in following equation 13.

[13]

$$Z(k) = \begin{cases} buf2(k) & (k = 0, \ldots N-1) \\ X2'(k) & (k = N, \ldots 2N-1) \end{cases} \quad \text{(Equation 13)}$$

Next, orthogonal transform processing section 402 updates buffer buf2($k$) in accordance with following equation 14.

[14]

$$\mathrm{buf2}(k)=X2'(k)(k=0,\ldots N-1) \quad \text{(Equation 14)}$$

Next, orthogonal transform processing section 402 outputs decoded signal $y_n$ as an output signal.

Figure 5:
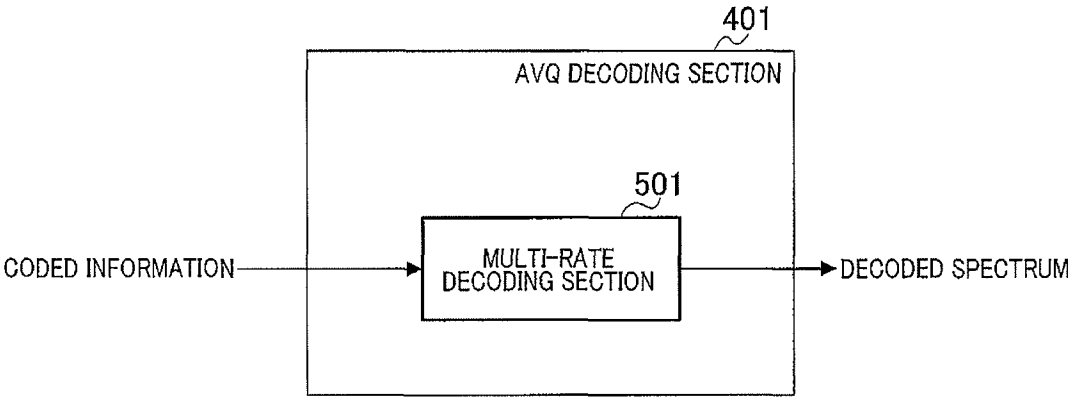
FIG. 5 is a block diagram showing the main configuration inside the AVQ decoding section shown in FIG. 4.

FIG. 5 is a block diagram showing a configuration inside AVQ decoding section 401 shown in FIG. 4. AVQ decoding section 401 is mainly formed of multi-rate decoding section 501. Multi-rate decoding section 501 receives as input coded information transmitted from coding apparatus 101 through a transmission channel, decodes the input coded information by inverse processing with respect to the processing in multi-rate indexing section 304 in AVQ coding section 202, and calculates decoded spectrum X2'(k). Here, since Non-Patent Literature 3 discloses the process in multi-rate decoding section 501 in detail, the explanations thereof will be omitted. Basically, multi-rate decoding section 501 performs the inverse processing with respect to the processing in multi-rate indexing section 304 and calculates decoded spectrum X2'(k).

The process in decoding apparatus 103 has been described hereinbefore.

In view of the above, according to the present embodiment, the quality of a decoded signal can be improved at a very low bit rate with a low amount of computation by executing a correction process on a cording target spectrum in performing encoding using an AVQ technique. To be specific, in a correction process, the characteristics of the configuration of a coding target spectrum are emphasized and simplified so that quantization of the spectrum is performed at a low bit rate in an AVQ technique. In the present embodiment, a method has been described in which an average amplitude value is calculated every sub-spectrum and all samples less than the average value are made zero, as an example of simplifying processing. The correction process reduces bits necessary for encoding a spectrum of each subband (a sub-spectrum) and thus can increase the number of subbands which can be coded at the same bit rate. As a result, quantization of spectrum data in a wide band is possible, thereby enabling the quality of a decoded signal (a band spread=a bandwidth) to be improved.

In the present embodiment, a method has been described in which the values of samples less than an average value are made zero using an average amplitude value in a sub-spectrum in spectrum correcting section 302. The present invention, however, is not limited to this method and can be applied to a configuration correcting a sub-spectrum using a method other than the above. For example, spectrum correcting section 302 may select only a predetermined number of samples in the descending order of amplitude among samples and assigns zero to the values of the other samples. At this time, the above predetermined number may be changed every subband, or may be changed on a time basis. For example, a method can be employed such as setting a large predetermined number for an important subband of a low band and setting a small predetermined number for subbands of a high band, which are of low energy. It is also possible to use a standard deviation for sub-spectrum correction instead of an average amplitude value, for example.

In the present embodiment, a configuration has been described in which spectrum data of input signals themselves are encoded by AVQ. The present invention, however, is not limited to this configuration, and can be equally applied to coding apparatus 101 of a configuration which further includes a core coding section that encodes a low band of input signals and in which AVQ coding section 202 encodes spectrum data of residual signals between input signals and core decoded signals (local decoded signals) acquired from the core coding section.

In the present embodiment, a case has been described where neighborhood search section 303 performs the same processing as the scheme disclosed in Non-Patent Literature 1 and Non-Patent Literature 3. The present invention is not limited to this case, however, and can be applied to a case where neighborhood search section 303 performs processing more adaptive to the processing in spectrum correcting section 302. For example, Non-Patent Literature 1 and Non-Patent Literature 3 disclose defining several selected vectors among vectors belonging to Qn as a leader in a codebook and using these vectors for encoding. Here, vectors to be corrected in spectrum correcting section 302 are preferentially selected upon defining vectors in a codebook as a leader. This increases the probability that a leader included in a codebook is selected upon encoding a target sub-spectrum (a corrected sub-spectrum). As a result, it is not necessary to utilize the coding technique using Voronoi extension disclosed in Non-Patent Literature 1 and Non-Patent Literature 3, thus reducing bits necessary for encoding a sub-spectrum. Accordingly, the effect of the present invention can be further enhanced.

In the present embodiment, a case has been described where spectrum correcting section 302 corrects a spectrum so as to reduce the number of bits required for encoding, as a result of transformation of a corrected sub-spectrum in neighborhood search section 303. However, the present invention is not limited the above and can further increase the effect by utilizing extra bits (reserved bits) in neighborhood search section 303. For example, there is a method of normalizing amplitude of a corrected sub-spectrum using extra bits, as an example. Specifically, a case of encoding a sub-spectrum (a test sub-spectrum) having eight subband widths {−16.4, 0.4, 1.6, 0.3, 4.4, 0.4, −1.6, −0.4} will be considered. In this case, spectrum correcting section 302 corrects the above test sub-spectrum to a corrected test sub-spectrum {−16.4, 0.0, 0.0, 0.0, 0.0, 0.0, 0.0, 0.0}. Neighborhood search section 303 transforms the corrected test sub-spectrum into a vector {16, 0, 0, 0, 0, 0, 0, 0} and further selects a leader {16, 0, 0, 0, 0, 0, 0, 0}. Since this leader belongs to Q4, and 16 bits are required for encoding the leader. However, a leader belonging to Q2 can be selected by normalizing a corrected sub-spectrum using extra bits and changing the leader from {16, 0, 0, 0, 0, 0, 0, 0} to {4, 0, 0, 0, 0, 0, 0, 0}, so that 8 bits of information amount is reduced (Note that it is necessary to transmit information "divided by 4" to the decoding apparatus side using extra bits). Accordingly, it is possible to further increase the effect of the present invention by encoding gain information other than a global gain using extra bits. Also, as described above, when extra bits are used for normalizing a corrected sub-spectrum, a higher effect can be expected by applying the extra bits to not all subbands but a part of subbands. For example, normalizing the corrected sub-spectrum by applying the above extra bits to only a subband having a relatively high energy can bring about a great effect in quality improvement with only the small number of extra bits. By the way, the number of subbands having a relatively high energy may be different every frame.

The present embodiment has described the configuration reducing the number of bits required for encoding each sub-spectrum and utilizing the number of reduced bits for encoding a sub-spectrum of other subbands. The present invention is not limited to this configuration, however, and can be equally applied to a configuration not using the number of reduced bits for encoding other subbands. In this case, a band spread (a bandwidth) decoded quality is not improved, but the bit rate can be significantly reduced without great quality degradation.

Although spectrum data indicated by a vector has been representatively used as a coding target in the present embodiment, the invention is not necessarily limited to this case. The same working effect can be acquired using different data which can represent the characteristic of input signals by a vector, as a coding target as with the present embodiment.

Also, decoding apparatus 103 according to the present embodiment performs processing using coded information transmitted from the above coding apparatus 101. The present invention is not limited to this case, however. Decoding apparatus 103 can decode coded information which is not from the above coding apparatus 101 as long as the coded information includes necessary parameter or data.

The present invention is equally applicable to a case where a signal processing program is recorded or written in a computer-readable recording medium such as a memory, a disk, a tape, a CD and a DVD and operated, and provides the same working effect and an advantage as with the present embodiment.

Although a case has been described above with the present embodiment as an example where the present invention is implemented with hardware, the present invention can be implemented with software.

Furthermore, each function block employed in the description of each of the present embodiment may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Furthermore, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be regenerated is also possible.

Furthermore, if an integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2010-004978, filed on Jan. 13, 2010, including the specification, drawings and abstract, is incorporated herein by reference in its entirety.

INDUSTRIAL APPLICABILITY

The coding apparatus and coding method according to the present invention can improve the quality of a decoded signal at a very low bit rate with a small amount of computation by executing a correction process on a cording target vector when performing encoding using an AVQ technique. The coding apparatus and coding method according to the present invention are suitable for a packet communication system and a mobile communication system, for example.

REFERENCE SIGNS LIST

101 Coding apparatus
103 Decoding apparatus
201 Orthogonal transform processing section
202 AVQ coding section
301 Global gain calculation section
302 Spectrum correcting section
303 Neighborhood search section
304 Multi-rate indexing section
305 Multiplexing section
401 AVQ decoding section

402 Orthogonal transform processing section
501 Multi-rate decoding section

The invention claimed is:

1. A speech coding method comprising:

performing a modified discrete cosine transformation for an input speech signal to provide spectrum data;

performing algebraic vector quantization coding using the spectrum data at a bit rate of 4 kbit/s or 12 kbit/s, the algebraic vector quantization coding comprising:

calculating a global gain for the spectrum data;

dividing the spectrum data into a plurality of subbands;

correcting the spectrum data of each subband of the plurality of subbands;

transforming the corrected spectrum data into a lattice vector;

calculating index information from the lattice vector; and multiplexing the global am with the index information to generate coded information, and outputting the coded information, which is related to the speech signal to be transmitted to a speech decoding apparatus, wherein the correcting calculates an average value of an amplitude of spectrum data for each subband, and assigns zero to a value of a sample having an amplitude equal to or less than the average value, among the group of samples related to the spectrum data of each subband, wherein at least one of the performing modified discrete cosine transformation, performing algebraic vector quantization coding, calculating a global gain, dividing, correcting, transforming, calculating index information and multiplexing is performed by a processor.

2. A speech coding apparatus comprising:

a processor; and a memory storing instructions, wherein the processor performs the instructions stored in the memory, and comprises:

an orthogonal transformer that performs a modified discrete cosine transformation for an input speech signal to provide spectrum data; and an algebraic vector quantization encoder that performs algebraic vector quantization coding using the spectrum data at a bit rate of 4 kbit/s or 12 kbit/s, the algebraic vector quantization encoder comprising:

a global gain calculator that calculates the spectrum data, a spectrum corrector that divides the spectrum data into a plurality of subbands and corrects the spectrum data of each subband of the plurality of subbands, a transformer that transforms the corrected spectrum data into a lattice vector, a multi-rate indexer that calculates index information from the lattice vector, and a multiplexer that multiplexes the global gain with the index information to Generate coded information, and outputs the coded information, which is related to the speech signal to be transmitted to a speech decoding apparatus, wherein the spectrum corrector evaluates a magnitude of an amplitude of spectrum data for each subband, selects a predetermined number of samples in a descending order of the magnitude of the amplitude, among a group of samples related to the spectrum data of each subband, and assigns zero to the value of the sample other than the selected predetermined number of samples.

3. A speech coding apparatus comprising:

a processor; and a memory storing instructions, wherein the processor performs the instructions stored in the memory, and comprises:

an orthogonal transformer that performs a modified discrete cosine transformation for an input speech signal to provide spectrum data; and an algebraic vector quantization encoder that performs algebraic vector quantization coding using the spectrum data at a bit rate of 4 kbit/s or 12 kbit/s, the algebraic vector quantization encoder comprising:

a global rum data, a spectrum corrector that divides the spectrum data into a plurality of subbands and corrects the spectrum data of each subband of the plurality of subbands, a transformer that transforms the corrected spectrum data into a lattice vector, a multi-rate indexer that calculates index information from the lattice vector, and a multiplexer that multiplexes the global gain with the index information to generate coded information and out uts the coded information which is related to the speech signal to be transmitted to a speech decoding apparatus, wherein the spectrum corrector calculates an average value of an amplitude of spectrum data for each subband and assigns zero to a value of a sample having an amplitude equal to or less than the average value, among a group of samples related to the spectrum data of each subband.

4. A base station system comprising the coding apparatus according to claim 3.

5. The coding apparatus according to claim 3, wherein the spectrum corrector further comprises a normalizer that normalizes the corrected spectrum data.

6. The coding apparatus according to claim 5, wherein the normalizer normalizes a part of the plurality of subbands.

7. The coding apparatus according to claim 6, wherein a number of subbands normalized by the normalizer varies every frame.

8. A communication terminal system comprising the coding apparatus according to claim 3.

* * * * *